US008292261B2

(12) United States Patent
Landreau et al.

(10) Patent No.: US 8,292,261 B2
(45) Date of Patent: Oct. 23, 2012

(54) SECURED WATER AND/OR AIR DISPENSER FOR SNOWMAKING SYSTEM, EQUIPPED WITH AN ELECTRIC-ACTUATOR-DRIVEN VALVE

(75) Inventors: Damien Landreau, Geste (FR); Eric David, Treillieres (FR); Pierrick Jouneau, Treillieres (FR); Michel Galvin, Carquefou (FR)

(73) Assignee: Johnson Controls Neige SAS, Sainte Luce sur Loire (FR)

( * ) Notice: Subject to any disclaimer, the term of this patent is extended or adjusted under 35 U.S.C. 154(b) by 879 days.

(21) Appl. No.: 12/324,910

(22) Filed: Nov. 28, 2008

(65) Prior Publication Data

US 2009/0140069 A1 Jun. 4, 2009

(30) Foreign Application Priority Data

Nov. 29, 2007 (FR) ..... 07 08339

(51) Int. Cl.
*F16K 31/02* (2006.01)

(52) U.S. Cl. ..... 251/129.01; 251/129.04; 251/69; 251/70; 307/23; 307/44; 318/563; 318/565; 239/2.2; 239/14.2

(58) Field of Classification Search ..... 307/23, 307/44–48, 64, 66, 117, 130, 328; 251/129.1, 251/129.04, 68, 69, 70; 318/563, 565, 159; 361/139, 156, 192, 152, 170, 187, 205; 239/2.2, 239/14.2, 99; 700/13, 21, 79, 82
See application file for complete search history.

(56) References Cited

U.S. PATENT DOCUMENTS

| | | | | |
|---|---|---|---|---|
| 3,486,068 | A * | 12/1969 | Dunn et al. | 315/87 |
| 3,606,971 | A | 9/1971 | Harrison et al. | |
| RE30,135 | E * | 11/1979 | Fitzwater et al. | 74/2 |
| 5,012,121 | A * | 4/1991 | Hammond et al. | 307/64 |
| 5,031,832 | A | 7/1991 | Ratnik et al. | |
| 5,149,185 | A * | 9/1992 | Mandy | 362/20 |

(Continued)

FOREIGN PATENT DOCUMENTS

JP 2004-275273 10/2004

(Continued)

OTHER PUBLICATIONS

French Patent Office Preliminary Search Report, dated Sep. 3, 2008 and issued in corresponding French Patent Publication No. 07/08339.

*Primary Examiner* — John K Fristoe, Jr.
*Assistant Examiner* — Minh Le
(74) *Attorney, Agent, or Firm* — Young & Thompson

(57) ABSTRACT

A water and/or air dispenser for snowmaking system includes water and/or air supplying ducts and is equipped with at least one valve (9) associated with an electric actuator (10), the actuator (10) being connected to an electric power source (12, 19) and associated with its own management unit (11) to ensure the operation of the valve (9) between the open and closed configurations thereof. The dispenser is associated with security elements able to cause the valve (9) to be positioned in a known security configuration, for example tightly closed, in case of voltage cut-off at the electric source (12, 19), the security elements being integrated and including a capacitor-type electric unit (16), connected to the electric power source and to the actuator (10), the capacitor unit being able to store, and then return, a quantity of energy necessary for complete actuation of the valve, to implement the security elements.

19 Claims, 2 Drawing Sheets

U.S. PATENT DOCUMENTS

| | | | | |
|---|---|---|---|---|
| 5,278,454 | A * | 1/1994 | Strauss et al. | 307/64 |
| 5,400,965 | A * | 3/1995 | Ratnik et al. | 239/2.2 |
| 5,422,808 | A | 6/1995 | Catanese, Jr. et al. | |
| 5,519,295 | A * | 5/1996 | Jatnieks | 318/453 |
| 5,623,172 | A * | 4/1997 | Zaretsky | 307/117 |
| 5,744,876 | A * | 4/1998 | Fangio | 307/66 |
| 5,818,125 | A * | 10/1998 | Manchester | 307/66 |
| 6,100,655 | A * | 8/2000 | McIntosh | 307/66 |
| 6,225,708 | B1 * | 5/2001 | Furukawa et al. | 307/66 |
| 6,554,200 | B1 * | 4/2003 | Satonaka | 239/2.2 |
| 6,628,011 | B2 * | 9/2003 | Droppo et al. | 307/43 |
| 6,994,357 | B2 * | 2/2006 | Heller et al. | 280/5.502 |
| 7,134,672 | B2 * | 11/2006 | Beishline et al. | 280/5.502 |
| 7,874,500 | B2 * | 1/2011 | Santry | 239/14.2 |
| 8,138,706 | B2 * | 3/2012 | Ochsenbein et al. | 318/563 |
| 2007/0273209 | A1 * | 11/2007 | Endou | 307/45 |
| 2008/0297124 | A1 * | 12/2008 | Koljonen et al. | 323/234 |
| 2010/0007301 | A1 * | 1/2010 | Ochsenbein et al. | 318/563 |

FOREIGN PATENT DOCUMENTS

| | | |
|---|---|---|
| KR | 2002-0006111 | 1/2002 |

* cited by examiner

SECURED WATER AND/OR AIR DISPENSER FOR SNOWMAKING SYSTEM, EQUIPPED WITH AN ELECTRIC-ACTUATOR-DRIVEN VALVE

The present invention belongs to the general field of artificial snow production. More particularly, it relates to a secured water and/or air dispenser for snowmaking system, equipped with a valve driven by an electric actuator; it also relates to the secured snowmaking equipment comprising such dispensers.

BACKGROUND OF THE INVENTION

Today's snowmaking equipments generally comprise several dozens of snowmakers distributed along the slope to be equipped and each supplied with water and possibly with air through branches of main ducts running along the slope (see notably documents KR-2002 000 6111 or U.S. Pat. No. 5,031,832).

At each snowmaker, these branches end at a water and/or air dispensing system which is equipped with means for managing the desired water and/or air flow rates of the snowmaker in question, these means generally consisting in a valve associated with a double-acting electric actuator supplied with a control voltage of typically 230 VAC.

These devices, as well as the management means thereof, are accommodated in a shelter located in close proximity of the snowmaker. For operation, they are supplied from the electricity network, typically 230 VAC.

For such equipments, it is important that the valve supplying the snowmaker can be placed in security configuration in case of electricity network failure. Indeed, in case of current cut-off during the snowmaker operation, in absence of such a security, the valve would stay in a defined configuration, with no more control possibility.

To that end, the snowmaking equipment conventionally comprises a back-up power supply, mounted in parallel with the main power supply, comprising a battery associated with a centralized inverter enabling, from an absence of current detected on the main power supply, to place all the valves of the slope snowmakers in a definite security configuration (fully and tightly closed state, or else).

However, these centralized security means need regular maintenance (in particular, for controlling the battery charge) and the overall production cost thereof is relatively high.

Further, an electric problem at one of the snowmakers may entail consequences on the operation of the whole equipment; for example, a short-circuit in a 230 VAC-powered motor will activate the differential security protection of the whole trail or slope.

SUMMARY OF THE INVENTION

In this framework, the object of the present invention is to remedy the above-mentioned shortcomings through a novel security system implementing simple, efficient and cheap means.

So, according to the present invention, the corresponding security means are integrated into the own management means of each dispenser and they comprise a capacitor-type electric unit connected to the electric power source and to the actuator, said capacitor unit being able to store, and then return, a quantity of energy necessary for complete actuation of the valve, this energy returning being used, during a voltage cut-off at the power source, to implement said security means.

According to a preferred embodiment, the management means of the valve actuator comprise a charger module located upstream from the capacitor unit, and on the other hand, a voltage up-converter unit located downstream from said capacitor unit, to recreate a supply voltage adapted to said valve actuator from the voltage generated by said capacitor unit.

On the other hand, the management means advantageously also comprise a control logic arranged to drive said actuator, said control logic being power-supplied from the voltage up-converter unit and associated with means for detecting the voltage cut-off at the electric source in order, when a power outage is detected, to drive said actuator so as to position the associated valve in the aimed security configuration.

In the framework of this preferred embodiment, the electric source supplies direct current to the charger module, the voltage up-converter unit also supplying direct current to feed an electric actuator powered with direct current or, in association with an inverter stage, with alternating current.

For example, a control voltage of 24 VDC intended for supplying the valve actuator as well as a control voltage of 5 VDC intended for supplying the control logic will be generated. Of course, other voltages are possible, including of electricity network (typically 230 VAC).

The means for detecting a voltage cut-off at the electric power source advantageously consist in a threshold relay interposed between the control logic and said electric source, upstream from the charger module.

According to another feature, the actuator is connected to the electric power source only through the charger module, the capacitor unit and the voltage up-converter unit, so as to ensure continuously the good operation of the security means.

Advantageously, the capacitor unit has a value between 20 and 1000 farads; more preferably, this value is between 100 and 300 farads.

Still according another feature, the dispenser management means comprise means for remotely reporting the voltage absence, as well as possibly means for transmitting certain state or measurement parameters related to the equipped valve, or the environment thereof, during the phase of absence of current.

The invention also relates to the operating method of the above-described dispenser, said method consisting in:

- charging and keeping charged the capacitor unit when the management means are powered from the electric power source,
- detecting the voltage cut-off of the electric source, and
- driving the actuator of the valve so as to cause the latter to be placed in the secured configuration, using the energy stored and returned by said capacitor unit.

The invention also relates to a snowmaking equipment equipped with a plurality of snowmakers each comprising a secured dispenser such as above-described, in which a control logic drives the electric actuator and is connected to a network management system, of the computer or programmable logic controller type, through a communication line. This communication line comprises at least one signal amplifying device connected to an electric power source, said signal amplifier comprising a secured supplying device including a charger module, a capacitor unit and a voltage up-converter unit, said capacitor unit being able to store a quantity of energy necessary for information to be transmitted on the communication line during a period long enough for the network management system to ensure that all the dispensers are placed in security condition, and then return thereof, this energy returning being used, during a voltage cut-off at the electric power source, to supply the signal amplifying device.

BRIEF DESCRIPTION OF THE DRAWINGS

The invention will be further illustrated, without being in any way limited, by the following description associated with the attached drawings, in which.

DETAILED DESCRIPTION OF THE PREFERRED EMBODIMENTS

Figure 1:
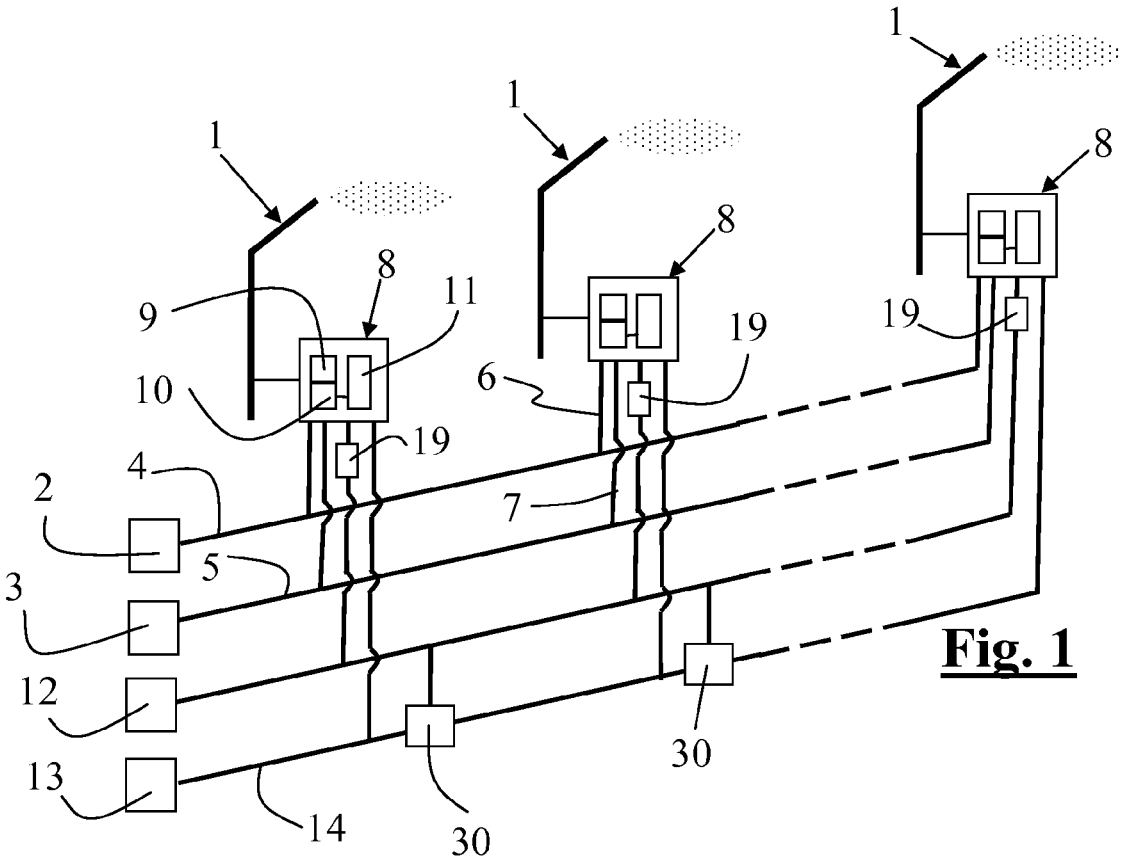
FIG. 1 schematically illustrates an equipment for artificial snowmaking comprising a plurality of snowmakers each associated with a water and air dispenser equipped with a valve driven thanks to an electric actuator.

The snowmaking equipment illustrated in FIG. 1 comprises a plurality of snowmakers 1 arranged to make artificial snow from pressurized water and air.

To that end, the equipment comprises an air source 2 and a water source 3 which supply each snowmaker 1 through main ducts, respectively 4 and 5, and branches 6, 7. The water and air ducts end, in each snowmaker 1, at a dispenser 8 which is equipped with a valve 9 associated with an electric actuator 10 arranged to manage the water and air flow rates. This management is done individually at each snowmaker 1.

In operation, each dispenser 8 is driven by management means 11 and power-supplied from a source 12. These management means 11 are connected to a network management system 13, of the computer or programmable logic controller type, through a communication line 14.

According to the present invention, each dispenser 8 includes its own security means arranged to place the associated valve 9 in a given so-called "security" configuration, in case of outage of power supply 12. For example, this security configuration may consist in a tightly closed configuration of valve 9, stopping the water and air supply of the snowmaker.

Figure 2:
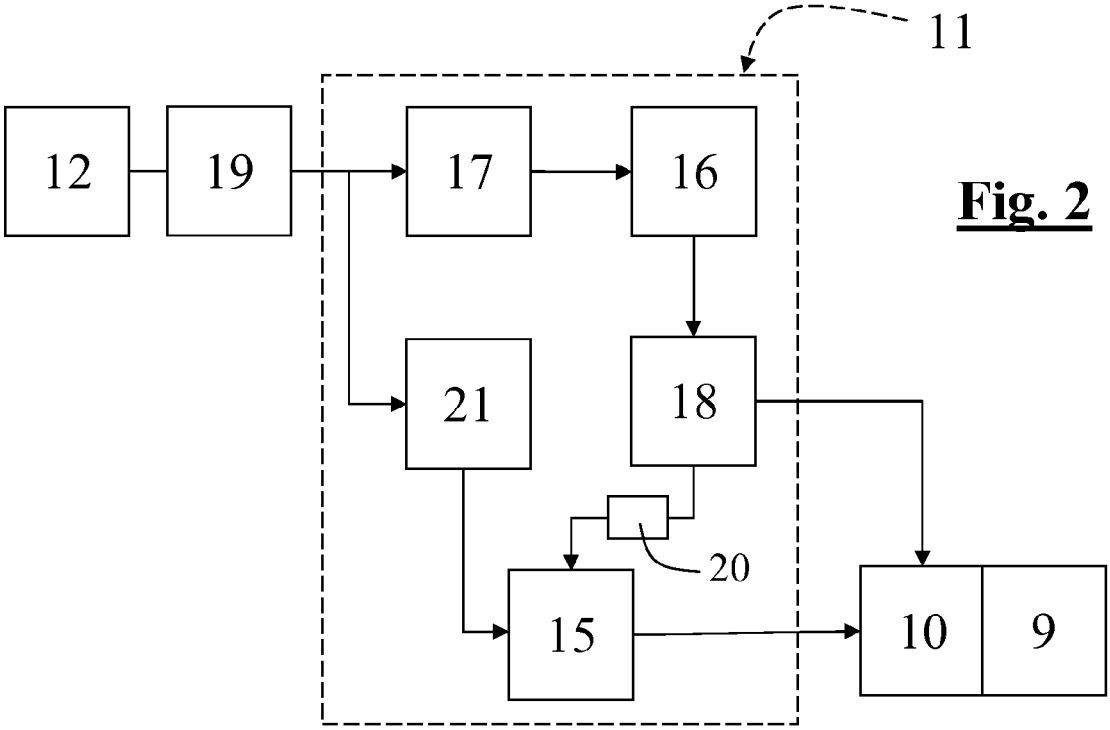
FIG. 2 is a general synoptic diagram illustrating the main functionalities of a dispenser according to the invention associated with each snowmaker.

These particular means appear in the synoptic diagram of FIG. 2, showing the main functional elements of management means 11 of actuator 10.

As illustrated in FIG. 2, actuator 10 is driven by a micro-controller-type control logic 15 and is power-supplied from power supply 12, through a capacitor unit 16 which is associated upstream to a charger module 17 and downstream to a voltage up-converter unit 18.

Each actuator 10 is advantageously of the double-acting type and is powered with direct current. From a general power supply 12 supplying a voltage of 230 VAC, a power supply 19 arranged at each shelter of snowmaker 1 provides the required direct current supply.

For example, for an actuator 10 of the 24 VDC-powered reversible stepping motor type, power supply 19 supplies 24 VDC, charger module 17 is of the 24 VDC/5 VDC type, and voltage up-converter unit 18 is of the 5 VDC/24 VDC type.

Capacitor unit 16 needs to be adapted for storing a quantity of energy necessary for complete actuation of valve 9 by actuator 10. According to the characteristics of valve 9 and actuator 10 thereof, this capacitor unit 16 will have a preferential value between 100 and 300 farads; in particular, for a slide-type valve 9 and a 12-watts DC power electric geared motor-type actuator 10, two modules mounted in series can be used, each having a value of 350 farads (for example, ref. Maxwell BCAP 350F), to obtain a total value of 175 farads.

These capacitor values enable, in case of outage of power supply 12, 19, to ensure the operation of actuator 10 during a period long enough for the slide of valve 9 to be displaced, over a complete back or forward stroke, at least, so as to place this valve in the selected security configuration (the corresponding operation duration is relatively long, of the order of 1 to 6 minutes, because of the use of an electric geared motor).

Still in FIG. 2, it can be noticed that micro-controller 15 is supplied from voltage up-converter unit 18 via a 24 VDC/5 VDC-type converter system 20.

On the other hand, this micro-controller 15 is associated with means 21 that enable an outage of power supply 12, 19 to be detected; these means herein consist in a threshold relay 21 interposed between power supply 19 and micro-controller 15 (upstream from charger module 17).

Consequently, in a "normal" operation, actuator 10 is supplied with electric current via the charger/capacitor/up-converter unit 17, 16, 18, after the energy is stored and returned by the capacitor unit 16. Presence of this charger 17/capacitor 16/up-converter 18 unit is virtually transparent.

In case of outage of power supply 12, 19, the energy stored in capacitor unit 16 enables operation of micro-controller 15 to be continued and actuator 10 to be actuated.

Micro-controller 15 is informed of the supply outage by threshold relay 21 and it drives actuator 10 to reach the aimed security configuration of valve 9.

As above-stated, the features of capacitor unit 16 are adapted for returning a sufficient energy with regard to this functionality, according to the operation characteristics of valve 9 and associated actuator 10.

All dispensers 8 of the snowmaking equipment operate similarly and it is to be understood, then, that a supply voltage failure causes the whole equipment to be placed in security condition.

Further to this placement in security condition of valve 9, management means 11 of each dispenser 8 can be programmed and structured for:

- remotely reporting the detected absence of voltage (for example, a specific alarm code will possibly be sent by micro-controller 15 to network management system 13, through communication line 14),
- transmitting, still remotely, in particular to network management system 13, certain state or measurement parameters related to associated valve 9 (or the environment thereof) during the phase of absence of voltage (for example: placement in security position done, valve-slide stroke percentage done, fluid local pressure, flow rate, ambient temperature or fluid temperature . . . ).

Following an outage of power supply 12, 19, micro-controller 15 continues to operate as long as it is sufficiently supplied from converter module 20 (itself supplied from up-converter unit 18).

Once capacitor unit 16 is fully discharged, valve 9 is immobilized by double-acting actuator 10 which is not any more supplied. Network management system 13 knows, thanks to the message sent, if valve 9 is in security position or not. If this valve 9 is in security position, a simple supply outage alarm is emitted; when power supply is restored, micro-controller 15 begins a sequence of snowmaker restarting, possibly under control of network management system 13. If valve 9 is not in security position, a fault is generated by network management system 13 and an intervention demand will possibly be automatically launched, notably by phone calling.

In "normal" operation, as actuator 10 is connected to power supply 12, 19 through the charger 17/capacitor 16/voltage up-converter 18 unit, an operation fault of either of these elements leads to an absence of supply of associated actuator 10. This dysfunctioning will be directly detected by micro-controller 15, and/or by the absence of communication between valve 9 and network management system 13, and/or by absence of information provided by the sensors of the valve, which enable the good operation of corresponding security means to be continuously ensured.

It is to be noticed that, if actuator 10 is powered with alternative current, it is enough to add an inverter stage to voltage up-converter unit 18 to convert the supplied direct current into alternative current.

Figure 3:
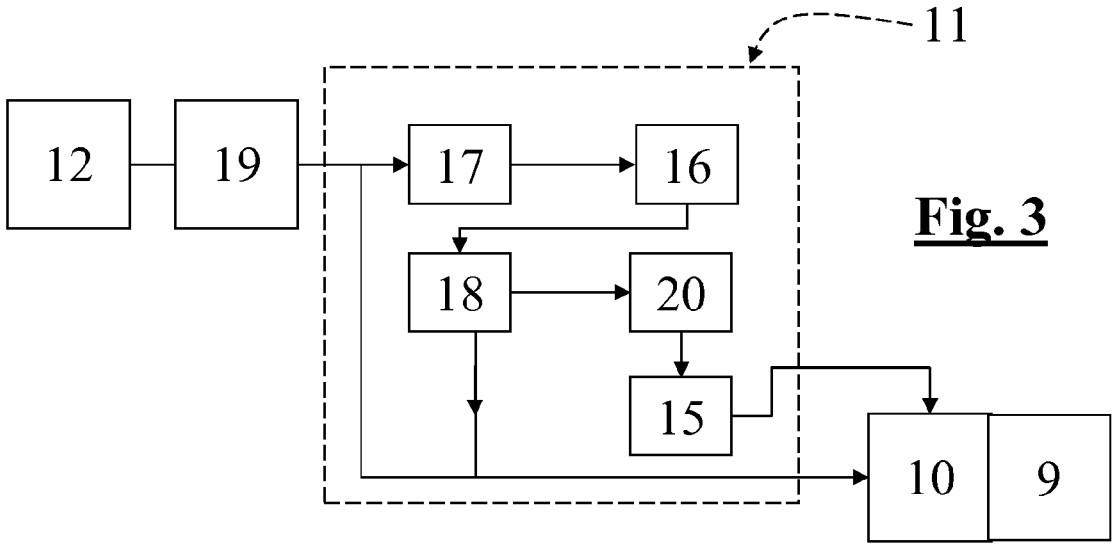
FIG. 3 is a general synoptic diagram of an embodiment variant of the dispenser of FIG. 2.

As shown in the schematic synoptic diagram of FIG. 3, in an embodiment variant, the security unit (charger 17/capacitor 16/voltage up-converter 18) can be arranged in parallel with a direct supply of actuator 10 from power supply 19.

Figure 4:
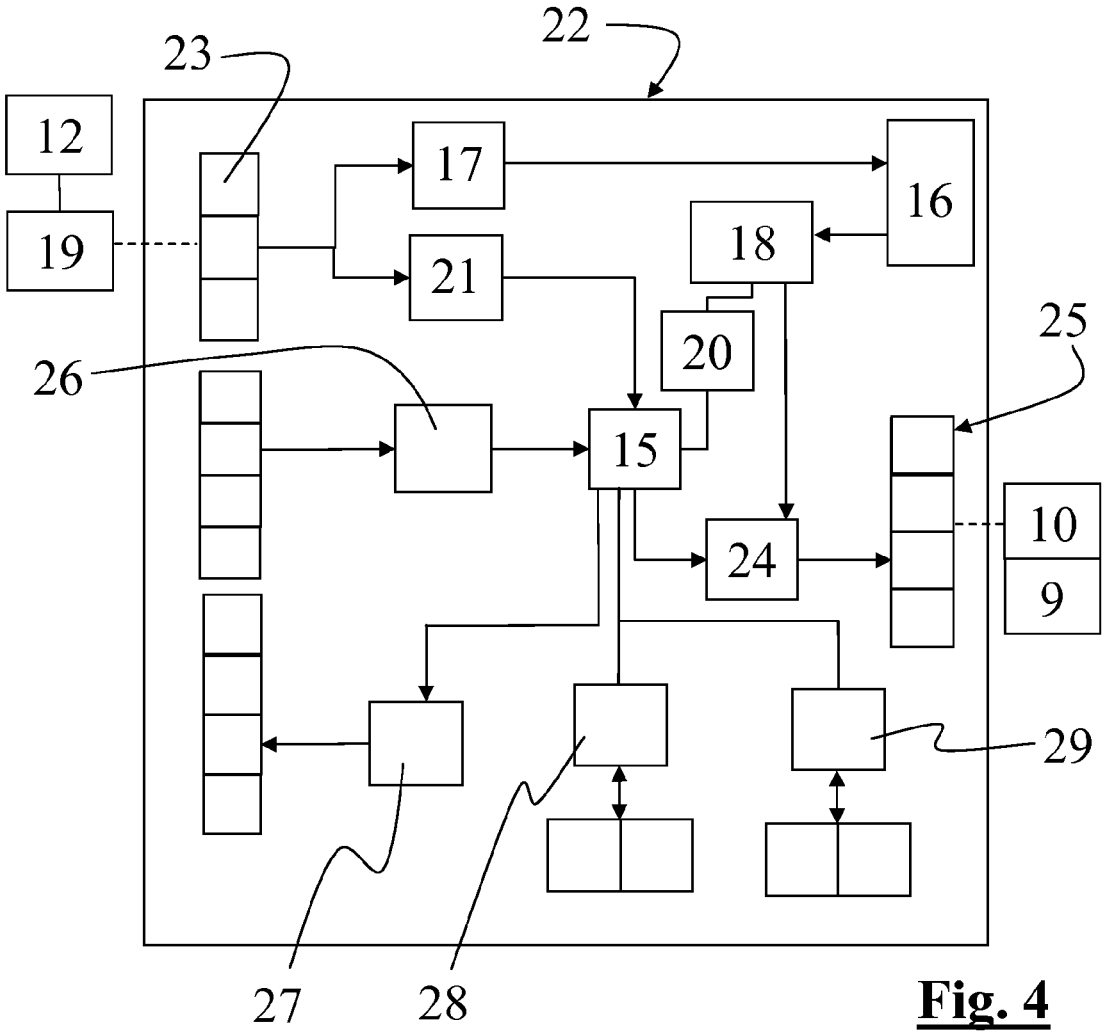
FIG. 4 is a bloc diagram of a control board of the valve actuator, according to the synoptic diagram of FIG. 2.

FIG. 4 shows a bloc diagram of a control electronic board able to manage the operation of a dispenser 8 according to the invention, and in particular according to the synoptic diagram of FIG. 2.

This board 22 includes micro-controller 15, capacitor charger 17 connected to supply connector 23 and capacitor unit 16, voltage up-converter 18 connected to said capacitor unit 16 and to a power stage 24, the latter being connected to connector 25 of actuator 10.

Micro-controller 15 is power-supplied from voltage up-converter unit 18 through converter 20.

Threshold relay 21 is interposed between supply connector 23 and micro-controller 15 (in an embodiment variant, means for detecting absence of voltage can be implemented by a suitable software function of the micro-controller).

On the other hand, micro-controller 15 is herein connected to:

- TOR inputs 26, for acquiring state information about certain parts (for example, stroke ends of the valve slide)
- TOR outputs 27, intended for the driving of various accessory parts by micro-controller (for example, secondary valves)
- analog inputs 28, for acquiring values of the physical magnitude transmitters (pressure, flow rate, temperature . . .)
- communication ports 29 for dialogue between micro-controller 15 and network management system 13; and also for communication between the micro-controller and the different measuring parts necessary for the driving of valve 9 or snowmaker 1.

Of course, the final electric diagram will take into account conventional electric and electronic protections and adaptations.

On the other hand, given the long distances to be equipped (sometimes several dozens of kilometres) and due to the need for remotely controlling dispensers 8, an amplification of communication signals can prove necessary, at regular intervals or not. This amplifying function is entrusted to electronic boards called "repeaters", denoted 30 in FIG. 1. These boards are supplied from main voltage 12 (230 VAC). For optimization and securing of the equipment, these repeaters 30 are advantageously equipped with a secured power supply device similar to that above-described for dispensers 8.

This device will comprise a 5 VDC-power supply, associated with a charger/capacitor(s)/voltage up-converter security unit (mounted in series or in parallel with the conventional power supply). The characteristics of the components used (in particular, values of the capacities) will be adapted to enable repeaters 30 so equipped to continue being supplied a few minutes following the outage of the main power supply 12. Given the absence of mechanical parts to be operated, the values of the capacitor(s) used will possibly be noticeably lesser relative to those above-mentioned for dispenser 8.

Generally, it will be noticed that the present invention applies not only to the dispenser of the snowmaker, but also to any other dispenser placed on the snowmaking network, for example a dispenser for controlling the distribution of the water flow rates in the snowmaking network. In particular, in great networks, it can be useful to arrange such a device to restrict the drainage flow rate in some areas so as to optimize the water returning into the tank.

In this case, a drainage strategy for emergency situations will be materialized by a sequence in network management system 13 (then, the security configuration of the valve will possibly correspond to an open position at a certain set value).

In any case, structure of the means according to the invention is adapted according to the types of valve 9 and actuator 10 that are present. It also can be contemplated to secure, through means according to the invention, a mere air valve necessary at a place or another of the snowmaking equipment. For example, valves 9 can be of the single-fluid or double-fluid type and of the slide, spherical plug, butterfly, seat style or the like. Actuators 10 can be of the brushless geared motor type or of the stepping geared motor type.

On the other hand, as above-stated, any security configuration will be possible, according in particular to the valve type, for example tightly closed, or else partially open or totally open.

The invention claimed is:

1. A water and/or air dispenser for a snowmaking system in connection with water and/or air supplying ducts (6, 7), comprising:

at least one valve (9) associated with an electric actuator (10), said actuator (10) being connected to a electric power source (12, 19) and associated with a management means (11) to ensure operation of said valve (9) between open and closed configurations thereof, said electric actuator (10) being connected to the electric power source (12, 19) via a charger module (17), followed by a capacitor unit (16) and a voltage up-converter unit (18), said capacitor unit (16) configured to store, and then return, a quantity of energy necessary for complete actuation of said valve (9), said charger module, capacitor unit and voltage up-converter unit forming security means that is configured, upon an occurrence of a voltage cut-off at the power source (12, 19), to return said quantity of energy from said capacitor unit and cause said valve to be positioned into a pre-determined security configuration.

2. The dispenser according to claim 1, wherein the charger module (17) is located upstream from the capacitor unit (16), and the voltage up-converter unit (18) is located downstream from said capacitor unit (16) and configured to recreate a supply voltage adapted to said valve actuator (10) from the voltage generated by said capacitor unit (16).

3. The dispenser according to claim 2, wherein the management means (11) also comprise a control logic (15) arranged to drive said actuator (10), said control logic (15) being power-supplied from the voltage up-converter unit (18) and associated with means (21) for detecting the voltage cut-off at the electric source (12, 19) in order, when a power outage is detected, to drive said actuator (10) so as to position the associated valve (9) in the aimed security configuration.

4. The dispenser according to claim 2, wherein the electric source (12, 19) supplies direct current to the charger module (17), the voltage up-converter unit (18) also supplying direct current to feed an electric actuator (10) powered with direct current or, in association with an inverter stage, with alternating current.

5. The dispenser according to claim 3, wherein the means for detecting a voltage cut-off at the electric power source (12, 19) consist in a threshold relay (21) interposed between the control logic (15) and said electric source (12, 19), upstream from the charger module (17).

6. The dispenser according to claim 2, wherein the actuator (10) is connected to the power source (12, 19) only through the charger module (17), the capacitor unit (16) and the voltage up-converter unit (18).

7. The dispenser according to claim 1, wherein the capacitor unit (16) has a value between 20 and 1000 farads.

8. The dispenser according to claim 7, wherein the capacitor unit (16) has a value between 100 and 300 farads.

9. The dispenser according to claim 1, wherein the management means (11) comprise means for remotely reporting the absence of voltage, as well as means for transmitting state or measurement parameters related to the equipped valve (9), or the environment thereof, during the phase of absence of current.

10. An operating method of the dispenser according to claim 1, comprising:

charging and keeping charged the capacitor unit (16) when the management means (11) are powered from the electric power source (12, 19);

detecting the voltage cut-off of the electric source (12, 19); and driving the actuator (10) of the valve (9) so as to cause the latter to be placed in the secured configuration, using the energy stored and returned by said capacitor unit (16).

11. Snowmaking equipment equipped with a plurality of snowmakers, each comprising a dispenser (8) that comprises at least one valve (9) in connection with an air and/or water supply duct, each valve associated with an electric actuator (10), said actuator (10) being connected to a electric power source (12, 19) and associated with a management means (11) to operate said valve (9) between open and closed configurations thereof, said dispenser (8) being also associated with security means configured to cause said valve (9) to be positioned in a known security configuration in the event of a voltage cut-off at said electric source (12, 19), said security means being integrated in said management means (11) and comprising a capacitor-type electric unit (16), connected to the electric power source (12, 19) and to the actuator (10), said capacitor unit (16) being able to store, and then return, a quantity of energy necessary for complete actuation of said valve (9), said quantity of energy, upon return, being used, during the voltage cut-off at the power source (12, 19), to implement said security means, wherein a control logic (15) drives the electric actuator (10) and is connected to a network management system (13), of the computer or programmable logic controller type, through a communication line (14), said communication line (14) comprising at least one signal amplifying device (30) connected to an electric power source (12), said signal amplifier (30) comprising a secured supplying device including a charger module, a capacitor unit and a voltage up-converter unit, said capacitor unit being configured to store, and then return, a quantity of energy necessary for information to be transmitted on the communication line (14) during a period long enough for the network management system (13) to ensure that all dispensers (8) are placed in security condition, this energy returning being used, upon the voltage cut-off taking place at the electric power source, to supply energy to the signal amplifying device.

12. The dispenser according to claim 3, wherein the electric source (12, 19) supplies direct current to the charger module (17), the voltage up-converter unit (18) also supplying direct current to feed an electric actuator (10) powered with direct current or, in association with an inverter stage, with alternating current.

13. The dispenser according to claim 3, wherein the means for detecting a voltage cut-off at the electric power source (12, 19) consist in a threshold relay (21) interposed between the control logic (15) and said electric source (12, 19), upstream from the charger module (17).

14. The dispenser according to claim 3, wherein the actuator (10) is connected to the power source (12, 19) only through the charger module (17), the capacitor unit (16) and the voltage up-converter unit (18).

15. The dispenser according to claim 3, wherein the capacitor unit (16) has a value between 20 and 1000 farads.

16. The dispenser according to claim 3, wherein the management means (11) comprise means for remotely reporting the absence of voltage, as well as means for transmitting state or measurement parameters related to the equipped valve (9), or the environment thereof, during the phase of absence of current.

17. The dispenser according to claim 1, wherein the predetermined security configuration is a configuration wherein the valve is tightly closed.

18. A dispenser for a snowmaker connected to a supply duct for water or air, comprising:

a valve in fluid connection with the supply duct;

an electric actuator configured to open and close the valve;

a management means configured to operate the electric actuator for opening and closing the valve, and an electric power source in electric connection with the electric actuator, the electric power source comprising a charger module, followed by a capacitor unit and a voltage up-converter unit, said capacitor unit being configured to store a quantity of energy sufficient for said electric actuator to completely actuate said valve into a pre-determined configuration, said quantity of energy, said charger module, capacitor unit and voltage up-converter unit forming a security means, wherein said capacitor unit is configured to provide said quantity of energy to the electric actuator upon an occurrence of a voltage cut-off at said electric source, thereby to activate the electric actuator to cause said valve to be positioned in a pre-determined security configuration.

19. The dispenser according to claim 18 wherein the predetermined security configuration of the valve is a position wherein the valve is tightly closed.

* * * * *